US011350668B2

(12) United States Patent
Liu et al.

(10) Patent No.: US 11,350,668 B2
(45) Date of Patent: Jun. 7, 2022

(54) PRODUCTION METHOD OF NEEDLE-TYPE HEATER

(71) Applicant: HUBEI CHINA TOBACCO INDUSTRY CO., LTD., Hubei (CN)

(72) Inventors: Huachen Liu, Hubei (CN); Yikun Chen, Hubei (CN); Aijun Dong, Hubei (CN); Weichang Ke, Hubei (CN); Bing Liu, Hubei (CN); Chenghao Luo, Hubei (CN); Tengfei Deng, Hubei (CN)

(73) Assignee: Hubei China Tobacco Industry Co., Ltd., Hubei (CN)

( * ) Notice: Subject to any disclaimer, the term of this patent is extended or adjusted under 35 U.S.C. 154(b) by 860 days.

(21) Appl. No.: 16/350,400

(22) PCT Filed: May 11, 2017

(86) PCT No.: PCT/CN2017/083973

§ 371 (c)(1),
(2) Date: Nov. 13, 2018

(87) PCT Pub. No.: WO2017/193958

PCT Pub. Date: Nov. 16, 2017

(65) Prior Publication Data

US 2019/0320719 A1 Oct. 24, 2019

(30) Foreign Application Priority Data

May 12, 2016 (CN) ..... 201610310575.2
Jan. 11, 2017 (CN) ..... 201710024509.3

(51) Int. Cl.
*H05B 3/00* (2006.01)
*A24F 40/46* (2020.01)
(Continued)

(52) U.S. Cl.
CPC ..... *A24F 40/46* (2020.01); *A24B 13/02* (2013.01); *A24B 15/12* (2013.01); *A24F 7/02* (2013.01); *A24F 40/70* (2020.01); *H01C 17/065* (2013.01); *H05B 3/44* (2013.01); *A24F 40/20* (2020.01); *H05B 2203/017* (2013.01); *Y10T 29/49083* (2015.01)

(58) Field of Classification Search
CPC ..... A24F 40/46; A24D 1/20; H05B 3/0014; H05B 2203/017; H05B 2203/022; H05B 3/06; H05B 3/44; A61M 15/06; A61M 11/042; A61M 11/041; Y10T 29/49826; Y10T 29/49083
USPC ..... 29/611, 428, 458, 745, 890.07
See application file for complete search history.

(56) References Cited

U.S. PATENT DOCUMENTS 8,794,231 B2 * 8/2014 Thorens ..... A61M 15/06 219/535
10,165,798 B2 * 1/2019 Xiang ..... B21F 15/00

* cited by examiner

*Primary Examiner* — Thiem D Phan
(74) *Attorney, Agent, or Firm* — Olive Law Group, PLLC

(57) ABSTRACT

A needle-type heater (9) includes a needle-shaped heating body and a heating element (20), wherein: the needle-shaped heating body includes a tapered cap (18) and a heater substrate (19) connected with a bottom of the tapered cap (18); and the heating element (20) is attached to the heater substrate (19) in a way of coated printing. A production method of the needle-type heater (9) and an electrically heated cigarette with the needle-type heater (9) are also provided. The needle-type heater (9) can fully heat a tobacco product, and the tobacco product is easier to be inserted into a heating cavity (8), so that it is convenient to replace the tobacco product and use.

3 Claims, 3 Drawing Sheets

(51) Int. Cl.

| | |
|---|---|
| ***A24B 13/02*** | (2006.01) |
| ***A24B 15/12*** | (2006.01) |
| ***A24F 7/02*** | (2006.01) |
| ***H05B 3/44*** | (2006.01) |
| ***A24F 40/70*** | (2020.01) |
| ***H01C 17/065*** | (2006.01) |
| *A24F 40/20* | (2020.01) |

PRODUCTION METHOD OF NEEDLE-TYPE HEATER

CROSS REFERENCE OF RELATED APPLICATION

This is a U.S. National Stage under 35 U.S.C. 371 of the International Application PCT/CN2017/083973, filed May 11, 2017, which claims priority under 35 U.S.C. 119(a-d) to CN 201610310575.2, filed May 12, 2016, and CN 201710024509.3, filed Jan. 11, 2017.

BACKGROUND OF THE PRESENT INVENTION

Field of Invention

The present invention relates to a technical field of cigarette, and more particularly to a needle-type heater, a production method of the needle-type heater and an electrically heated cigarette with the needle-type heater.

Description of Related Arts

Generally, burning of the cigarette needs to reach a temperature of higher than 800° C., and then multiple gaseous products and distillations generated by burning will be released from the tobacco. During burning of the cigarette, the essence and flavor added in the tobacco product will be decomposed with burning of the cigarette, which damages the original quality of the essence and flavor. In order to decrease the smoking temperature of the cigarette, the tobacco is specially processed and heated with a heater. Conventionally, the available heater for the electrically heated tobacco product in the market is a plate-type heater, and the cigarette to be heated is arranged longitudinally and orderly. However, the above heater cannot be directly inserted into the conventional cigarette.

Moreover, in the prior art, the cigarette which is heated externally, not heated through burning of the tobacco, generates the smoke through heating the tobacco product to the atomizing temperature, which is able to obviously decrease the harmful substances generated due to burning of the cigarette and decrease the damages of the secondhand smoke to the nonsmokers. However, when heating the tobacco product (such as the smoke bomb) with the conventional heater, only one side or the outer wall can be heated, so that the whole tobacco product, especially the internal tobacco, cannot be effectively heated. Because heating is insufficient, a part of tobacco is residual, which is difficult to be cleaned. In addition, it is difficult to insert the tobacco product into the heating cavity, and the heating cavity is inconvenient to be cleaned with the residual tobacco.

SUMMARY OF THE PRESENT INVENTION

An object of the present invention is to provide a needle-type heater, a production method of the needle-type heater and an electrically heated cigarette with the needle-type heater, so as to solve problems existing in the prior art. Through the needle-type heater, ends and interior of a tobacco product are fully heated, and it is easier to insert the tobacco product into a heating cavity. Moreover, it is convenient to replace the tobacco product, and it becomes more convenient to use.

Technical solutions of the present invention are described as follows.

A needle-type heater comprises a needle-shaped heating body and a heating element, wherein: the needle-shaped heating body comprises a tapered cap and a heater substrate connected with a bottom of the tapered cap; and the heating element is attached to the heater substrate in a way of coated printing.

Preferably, the tapered cap is in a shape of circular cone or triangular pyramid; and, the heater substrate is correspondingly in a shape of circular cylinder, elliptic cylinder, or triangular prism.

Preferably, an electrode is arranged at a tail end of the heater substrate; and the electrode is connected to a battery and a control board through a connecting wire.

A first production method of the needle-type heater comprises steps of:

(1), preparing and mixing materials: weighing alumina powders of D50<0.8 μm, and adding into a ball mill; then adding a certain amount of milling balls, wherein a weight ratio of the alumina powders to the milling balls is 1:2; then adding a binder into the ball mill, wherein the binder accounts for 3-15% of a total weight of raw materials; and continuously milling until the alumina powders and the binder are uniformly mixed;

(2), pugging: taking out the mixed powders; adding a lubricant which accounts for 3-10% of the total weight of the raw materials; then adding water which accounts for 15-20% of the total weight of the raw materials; uniformly stirring until uniformly mixed; taking out stirred pug, and placing into a rough pug mill for rough pugging; repeatedly pugging for at least three times, and obtaining alumina pug;

(3), aging: wrapping the alumina pug by a plastic wrap; aging for at least 48 hours; and obtaining a 96% alumina flexible ceramic body;

(4), cutting the ceramic body: placing the 96% alumina flexible ceramic body on a mechanical punch for size punching; and, after punching, obtaining a required dimension of a heater substrate and a heater supporting seat;

(5), printing: in a dust-free environment, printing resistance slurry on the flexible ceramic body after punching, so as to form a heating element thereon; and printing an electrode which is connected to the heating element;

(6), wrapping: wrapping the flexible ceramic body with the printed heating element and electrode on an alumina ceramic rod;

(7), forming: after warm isostatic pressing by a warm isostatic pressing machine at a temperature near 95-100° C., forming into a needle-shaped ceramic body;

(8), modifying: punching a heating-type ceramic sleeve preform body obtained after forming by the punch, and forming a tapered cap; checking and modifying sizes thereof;

(9), pre-firing: heating the modified ceramic sleeve preform body in a rubber removal furnace from a room temperature to 500° C. with a speed of <5° C./min, wherein: the temperature is kept at 100° C., 200° C., 300° C. and 400° C. respectively for 30 minutes and kept at a highest rubber removal temperature of 500° C. for 120 minutes, so as to completely remove organics;

(10), firing: in a reducing atmosphere filled with hydrogen, firing with a temperature increased to 500° C. with a speed of 10° C./min and then to 1650° C. with a speed of <5° C./min, and forming a heating-type ceramic sleeve; wherein the temperature is kept at 700° C., 900° C., 1100° C. and 1300° C. respectively for 30 minutes and kept at a highest firing temperature of 1500° C. for 120 minutes;

(11), welding: welding a connecting wire at the electrode of the heating-type ceramic sleeve after firing; and (12), tin dipping: processing the heating-type ceramic sleeve after welding with tin dipping at a welding point for 2-3 seconds.

Preferably, the alumina powders are pure alumina powders or a combination of mixing the alumina powders with at least one member selected from a group consisting of aluminum nitride, vein quartz, sandstone, quartzite, quartz sand, flint, diatomaceous earth, mullite, cordierite, wollastonite, andalusite, limestone, quartz, kaolin, potassium oxide, sodium oxide, calcium oxide, magnesium oxide, ferric oxide and titanium oxide.

Preferably, the lubricant consists of soybean oil and tung oil, wherein the soybean oil accounts for 40% of a total weight of the lubricant and the tung oil accounts for 60% of the total weight.

Preferably, the binder comprises at least one member selected from a group consisting of carboxymethyl cellulose, agar, gelatin and xanthan gum.

A second production method of the needle-type heater comprises steps of:

(1), surface preprocessing: according to a printing preprocessing technology, making a printing preparation for a 96% alumina flexible ceramic rod which has a diameter of 1.8 mm and has been processed with CNC premixed solution;

(2), curved-surface printing: in a dust-free environment, printing W—Mn slurry on the alumina ceramic rod through a curved-surface printing machine, so as to form a heating element and an electrode connected to the heating element thereon;

(3), pre-firing: pre-firing the 1.8 mm 96% alumina flexible ceramic rod with the printed heating element and electrode from a room temperature to 500° C. with a speed of <5° C./min, wherein: the temperature is kept at 100° C., 200° C., 300° C. and 400° C. respectively for 30 minutes and kept at a highest rubber removal temperature of 500° C. for 120 minutes, so as to completely remove organics;

(4), firing: in a reducing atmosphere filled with wet $H_2/N_2$, heating to 500° C. with a speed of 10° C./min and then to 1450° C. with a speed of <5° C./min, and firing; wherein the temperature is kept at 700° C., 900° C., 1100° C. and 1300° C. respectively for 30 minutes and kept at a highest firing temperature of 1450° C. for 60 minutes;

(5), immersing in glass slurry: cooling the alumina ceramic rod after firing to the room temperature; and then immersing in the glass slurry for 1-2 seconds, so that the glass slurry is uniformly coated on the processed alumina ceramic rod;

(6), drying: in a constant-temperature drum wind drying oven, processing the alumina ceramic rod after immersing with drum wind drying at 40° C., 60° C., 80° C. and 100° C. respectively for 2 hours and then at 120° C. for 4 hours;

(7), firing: heating to 1000° C. with a speed of <5° C./min, and then firing for glass packaging; wherein the temperature is kept at the highest temperature for 30 minutes;

(8), nickeling and welding: processing a heating-type ceramic needle obtained after firing with nickeling at the electrode, and fixing with a special mould; and, under a protection of dry $H_2/N_2$ atmosphere at 790° C., welding a circuit lead; and (9), tin dipping: processing the heating-type ceramic needle after welding with tin dipping at a welding point for 2-3 seconds.

An electrically heated cigarette with a needle-type heater comprises a power supply rod and an auxiliary inserter, wherein: the power supply rod comprises a shell with one end being open, and a power supply device and a heating unit which are arranged in the shell; the heating unit comprises a heater base and the needle-type heater mounted on the heater base; a needle-shaped heating body of the needle-type heater comprises a tapered cap and a heater substrate connected with a bottom of the tapered cap; a heating element is attached to the heater substrate in a way of coated printing; the power supply device is for supplying power to the heater base; the auxiliary inserter has a cavity structure that one end of the auxiliary inserter is open and the auxiliary inserter is able to be inserted into the shell; a hole is provided at a bottom of the auxiliary inserter for being inserted by the needle-type heater; inner walls of the auxiliary inserter form a heating cavity for placing a tobacco product; and, after being inserted into the hole, the needle-type heater stretches into the heating cavity and further to the tobacco product.

Preferably, the electrically heated cigarette further comprises a cigarette holder, wherein: the open end of the auxiliary inserter is detachably connected to the cigarette holder; and the open end of the shell is detachably connected to the cigarette holder.

Preferably, the heater base is fixedly connected with the shell; the needle-type heater is fixed on the heater base along an axial direction of the shell; and a pointed end of the needle-type heater is located near the open end of the shell.

Preferably, the number of the needle-type heater is at least one; when the number is two, the needle-type heaters are arranged in line; when the number is three, the needle-type heaters are arranged in line or equilateral triangle; and, when the number is four, the needle-type heaters are arranged in square.

Preferably, the power supply device comprises a battery, a controller and an electrode, wherein: an electrode base is arranged in the shell; the electrode is mounted on the electrode base; the battery is connected to the electrode through the controller; and the electrode is connected to the heater base.

Preferably, a cigarette holder cavity is formed inside the cigarette holder, and a multi-hole baffle is arranged at an end of the cigarette holder cavity near the shell.

Preferably, the needle-type heater has a length of 8 mm-35 mm and a diameter of 0.6 mm-3.0 mm.

Further preferably, the needle-type heater has a length of 10 mm-25 mm and a diameter of 0.8 mm-2.5 mm.

Preferably, the tobacco product is able to be prepared into a cylinder, a cube or a cuboid, and wrapped by a wrapping material.

The present invention has following beneficial effects. Firstly, through coating, the diameter of the heater is obviously decreased, which better matches the conventional cigarette structure. Secondly, with the external glaze seal of the heating element, the thermal efficiency is increased, the heat conduction becomes faster, and the oxidation resistance of the heating element is increased. Thirdly, the various forms of heaters can better match the conventional cigarette structure without requiring any big modification to the conventional device, which decreases the rolling cost of the cigarette. Fourthly, the needle-type heater is easier to be inserted into the cigarette, which reduces a density change of the tobacco shreds during the inserting process of the cigarette and guarantees the uniformity of the draw resistance. Fifthly, the heater has a high strength and a high-temperature resistance, is easy to be cleaned, and can work at a high temperature for a long time. Sixthly, through arranging the heater base and the needle-type heater in the power supply rod, the ends and the interior of the tobacco product can be heated at the same time and heated more fully than the prior art; moreover, through the auxiliary inserter, it is easy to insert the tobacco product to contact the needle-type heater, which is convenient for the user to use.

BRIEF DESCRIPTION OF THE DRAWINGS

FIG. 2(*b*) is a sectional view of FIG. 2(*a*).

FIG. 3(*b*) is a sectional view of FIG. 3(*a*).

FIG. 4(*b*) is a sectional view of FIG. 4(*a*).

FIG. 5(*b*) is a sectional view of FIG. 5(*a*).

In figures: 1: shell; 2: battery; 3: controller; 4: electrode base; 5: negative electrode; 6: positive electrode; 7: auxiliary inserter; 8: heating cavity; 9: needle-type heater; 10: cigarette holder interface; 11: cigarette holder cavity; 12: shell interface; 13: multi-hole baffle; 14: location hole; 15: cigarette holder; 16: heater base; 17: heater supporting seat; 18: tapered cap; 19: heater substrate; 20: heating element; and 21: connecting wire.

DETAILED DESCRIPTION OF THE PREFERRED EMBODIMENT

Technical solutions of the present invention are clearly and completely described with accompanying drawings as follows.

First Preferred Embodiment

Figure 1:
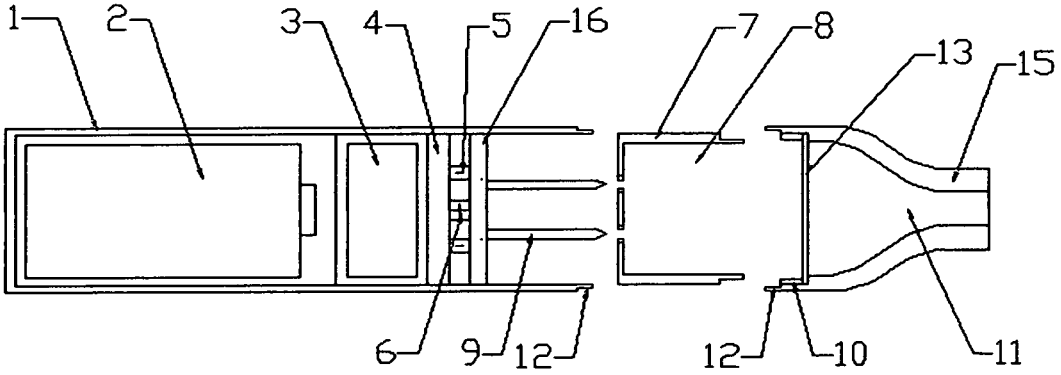
FIG. 1 is an exploded view of an electrically heated cigarette with needle-type heaters according to a first preferred embodiment of the present invention.
Figure 2A:
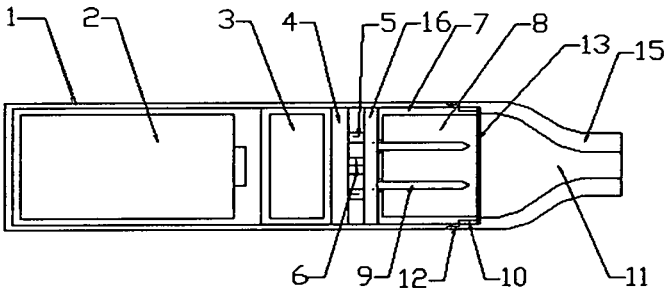
FIG. 2(*a*) is a sketch view of the electrically heated cigarette with the needle-type heaters after assembling according to the first preferred embodiment of the present invention.
Figure 2B:
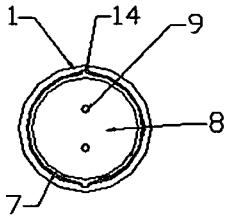

Referring to FIG. 1, FIG. 2(*a*) and FIG. 2(*b*), according to the first preferred embodiment of the present invention, an electrically heated cigarette with needle-type heaters is provided, wherein the number of the needle-type heaters is two. FIG. 1 shows structures of three parts of the present invention, wherein the three parts are respectively a power supply rod, an auxiliary inserter 7 and a cigarette holder 15.

The power supply rod comprises a shell 1, and a power supply device and a heating unit which are arranged in the shell 1, wherein: the power supply device comprises a battery 2, a controller 3, and electrodes (respectively a negative electrode 5 and a positive electrode 6); an electrode base 4 and a heater base 16 are further arranged in the shell 1; the negative electrode 5 and the positive electrode 6 are mounted on the electrode base 4; the needle-type heaters 9 are mounted on the heater base 16, so as to form the heating unit; the battery 2 is connected to the electrodes (namely the negative electrode 5 and the positive electrode 6) through the controller 3; the electrodes (namely the negative electrode 5 and the positive electrode 6) are connected with the heater base 16; the heater base 16 receives power supply from the battery 2 and then conducts heat to the needle-type heaters 9.

The battery 2 can be a rechargeable battery; the controller 3 controls the power supply device to supply power to the heating unit; the heating unit is controlled according to a preset temperature; when a temperature of the heating unit is higher than the preset temperature, the controller 3 stops supplying power to the heating unit; when the temperature of the heating unit is lower than the preset temperature, the controller 3 supplies power to the heating unit; one working period controlled by the controller 3 is generally no more than 7 min, usually preset to be 3 min-6 min. A heating temperature of the heating unit is 150° C.-360° C., preferably 180-340° C. and more preferably 250-320° C.

The needle-type heaters 9 are needle-shaped or rod-shaped; the heater base 16 is fixedly connected with the shell 1; the needle-type heaters 9 are fixed on the heater base 16 along an axial direction of the shell 1, and pointed ends of the needle-type heaters 9 are located near an open end of the shell. Each needle-type heater 9 has a length of 8 mm-35 mm, preferably 10 mm-25 mm, and a diameter of 0.6 mm-1.8 mm, preferably 0.8 mm-1.4 mm. The auxiliary inserter 7 has a cavity structure that one end of the auxiliary inserter is open and the auxiliary inserter is able to be inserted into an inner cavity of the shell 1; holes corresponding to the needle-type heaters 9 are provided at a bottom of the auxiliary inserter 7 for being conveniently inserted by the needle-type heaters 9. Inner walls of the auxiliary inserter 7 form a heating cavity 8 for placing a tobacco product; after being inserted into the holes, the needle-type heaters 9 stretch into the heating cavity 8; it is understandable that the length of each needle-type heater 9 is smaller than or equal to a depth of the heating cavity 8. The open end of the auxiliary inserter 7 is tightly connected to the cigarette holder 15 in a way of thread, grinding mouth, rubber ring or clip.

One end of the shell 1 is open; the battery 2 is arranged at a bottom of the shell 1; and the open end of the shell is detachably connected to the cigarette holder 15. For example, if a shell interface 12 is arranged at an outer wall of the open end of the shell 1, one corresponding shell interface 12 is arranged at an end of the cigarette holder 15. The detachable connection between the shell and the cigarette holder is realized in a way of inserted connection or screwed connection. A cigarette holder cavity 11 is formed inside the cigarette holder 15; a multi-hole baffle 13 is arranged at an end of the cigarette holder cavity 11 near the shell 1, for preventing the tobacco product from entering the cigarette holder cavity to influence a smoking feeling.

In other embodiments, it is also feasible not to arrange the cigarette holder 15, and the cigarette is directly inserted into the auxiliary inserter 7 and further to the needle-type heater 9.

According to the first preferred embodiment, the number of the needle-type heaters 9 is two, and two holes are correspondingly provided at the bottom of the auxiliary inserter 7. As shown in FIG. 2(*b*), the two holes are symmetrically provided at a central position of the bottom of the auxiliary inserter 7.

When using the electrically heated cigarette, the auxiliary inserter 7 and the cigarette holder 15 are firstly taken down; the tobacco product to be heated is added into the heating cavity 8 of the auxiliary inserter 7; then the auxiliary inserter 7 and the cigarette holder 15 are connected together through a cigarette holder interface 10; after a location hole 14 is aligned, the auxiliary inserter 7 and the cigarette holder 15 are inserted to the needle-type heaters 9 together; the pointed ends of the needle-type heaters 9 stretch into the heating cavity 8 through the holes provided at the bottom of the auxiliary inserter 7 and further to the tobacco product placed in the heating cavity 8. Through the controller 3, a current inputted to the needle-type heaters 9 from the battery 2 is controlled, so as to achieve heating and temperature control of the tobacco product and keep an atomizing temperature at 250° C.-320° C.

In the first preferred embodiment, according to structural forms of the needle-type heaters inserted into the heating cavity 8, the number of the needle-type heaters 9 is two. During a process of inserting the needle-type heaters into the tobacco product, a density of the tobacco product changes, so that a total weight of the prepared tobacco product is required to be kept at 600 mg-700 mg.

According to the first preferred embodiment, a preparation process of the tobacco product comprises steps of: drying tobacco leaves and crushing; sieving 1000 g tobacco powders smaller than 100 meshes; weighing 100 g seaweed gel, dissolving in 500 g water, stirring with the tobacco powders, and uniformly mixing; preparing into tobacco sheets and drying; after cutting the tobacco sheets into shreds, adding 150 g first atomizing agent which consists of glycerin and propylene glycol with a weight ratio of 4:1, baking for 30 minutes at 60° C., and keeping aside; meanwhile, weighing 1000 g tobacco shreds, spraying 150 g second atomizing agent which consists of glycerin and propylene glycol with a weight ratio of 1:3, baking for 30 minutes at 60° C., and keeping aside; uniformly mixing the prepared tobacco sheets and tobacco shreds with a weight ratio of 1:2; adding tobacco extract accounting for 4% of a total weight of the tobacco product and tobacco essence and flavor accounting for 1% of the total weight of the tobacco product; after uniformly mixing, wrapping with aluminum foil, and preparing into smoke bombs.

The prepared smoke bomb wrapped by the aluminum foil is firstly placed into the heating cavity 8, and thereafter smoothly inserted to the heaters 9 with the cigarette holder. During heating, smoke rapidly generates, which well meets a nicotine requirement of smoking.

Second Preferred Embodiment

Figure 3A:
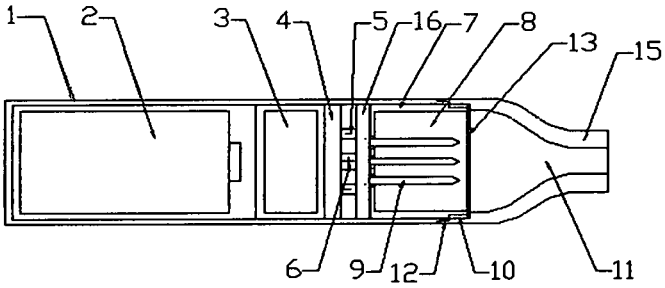
FIG. 3(*a*) is a sketch view of an electrically heated cigarette with needle-type heaters after assembling according to a second preferred embodiment of the present invention.
Figure 3B:
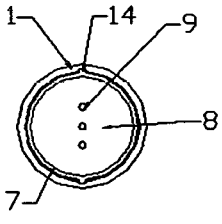

Referring to FIG. 3(*a*) and FIG. 3(*b*), according to the second preferred embodiment of the present invention, an electrically heated cigarette with needle-type heaters is provided, wherein the number of the needle-type heaters is three. Other structures are basically same as that shown in FIG. 2(*a*) and FIG. 2(*b*).

According to the second preferred embodiment, the number of the needle-type heaters 9 is three, which are arranged in line. During a process of inserting the needle-type heaters into a tobacco product, a density of the tobacco product changes, so that a total weight of the prepared tobacco product is required to be kept at 500 mg-600 mg, which facilitates inserting of the tobacco product.

According to the second preferred embodiment, a preparation process of the tobacco product comprises steps of: drying tobacco leaves and crushing; sieving 1000 g tobacco powders smaller than 100 meshes; weighing 50 g carrageenan and 50 g agar, dissolving in 500 g water, stirring with the tobacco powders, and uniformly mixing; preparing into tobacco sheets and drying; after cutting the tobacco sheets into shreds, adding 150 g first atomizing agent which consists of glycerin and propylene glycol with a weight ratio of 3:1, baking for 30 minutes at 60° C., and keeping aside; meanwhile, weighing 1000 g tobacco shreds, spraying 150 g second atomizing agent which consists of glycerin and propylene glycol with a weight ratio of 2:1, baking for 30 minutes at 60° C., and keeping aside; uniformly mixing the prepared tobacco sheets and tobacco shreds with a weight ratio of 3:5; adding tobacco extract accounting for 5% of a total weight of the tobacco product and tobacco essence and flavor accounting for 1% of the total weight of the tobacco product; after uniformly mixing, wrapping with aluminum foil, and preparing into smoke bombs.

The prepared smoke bomb wrapped by the aluminum foil is firstly placed into the heating cavity 8, and thereafter smoothly inserted to the heaters 9 with the cigarette holder. During heating, smoke rapidly generates, which well meets a nicotine requirement of smoking.

Third Preferred Embodiment

Figure 4A:
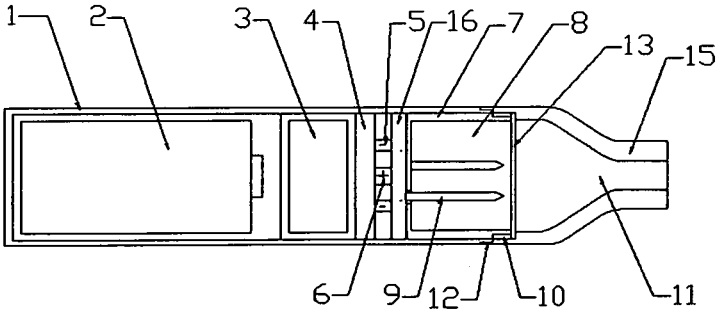
FIG. 4(*a*) is a sketch view of an electrically heated cigarette with needle-type heaters after assembling according to a third preferred embodiment of the present invention.
Figure 4B:
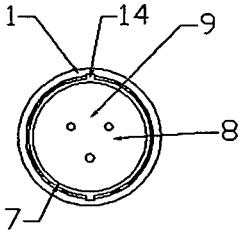

Referring to FIG. 4(*a*) and FIG. 4(*b*), according to the third preferred embodiment of the present invention, an electrically heated cigarette with needle-type heaters is provided, wherein the number of the needle-type heaters is three. The difference from the second preferred embodiment is in that the three needle-type heaters are arranged in equilateral triangle. Other structures are basically same as that shown in FIG. 2(*a*) and FIG. 2(*b*).

According to the third preferred embodiment, the number of the needle-type heaters 9 is three. During a process of inserting the needle-type heaters into a tobacco product, a density of the tobacco product changes, so that a total weight of the prepared tobacco product is required to be kept at 500 mg-600 mg, which facilitates inserting of the tobacco product.

According to the third preferred embodiment, a preparation process of the tobacco product comprises steps of: drying tobacco leaves and crushing; sieving 1000 g tobacco powders smaller than 100 meshes; weighing 80 g carboxymethyl cellulose and 25 g sodium alginate, dissolving in 500 g water, stirring with the tobacco powders, and uniformly mixing; preparing into tobacco sheets and drying; after cutting the tobacco sheets into shreds, adding 140 g first atomizing agent which consists of glycerin and propylene glycol with a weight ratio of 3:1, baking for 30 minutes at 60° C., and keeping aside; meanwhile, weighing 1000 g tobacco shreds, spraying 120 g second atomizing agent which consists of glycerin and propylene glycol with a weight ratio of 3:2, baking for 30 minutes at 60° C., and keeping aside; uniformly mixing the prepared tobacco sheets and tobacco shreds with a weight ratio of 2:3; adding tobacco extract accounting for 5% of a total weight of the tobacco product and tobacco essence and flavor accounting for 1% of the total weight of the tobacco product, wherein a flavor precursor of menthol is added into the tobacco essence and flavor according to the third preferred embodiment; after uniformly mixing, wrapping with aluminum foil, and preparing into smoke bombs.

The prepared smoke bomb wrapped by the aluminum foil is firstly placed into the heating cavity 8, and thereafter smoothly inserted to the heaters 9 with the cigarette holder. During heating, smoke rapidly generates; because of addition of the flavor precursor of the menthol, the smoke bomb does not have an obvious minty flavor; when using, a minty cool feeling is obvious. The cigarette is able to reach a decomposition temperature of the menthol, so as to increase the cool feeling of the smoke.

Fourth Preferred Embodiment

Figure 5A:
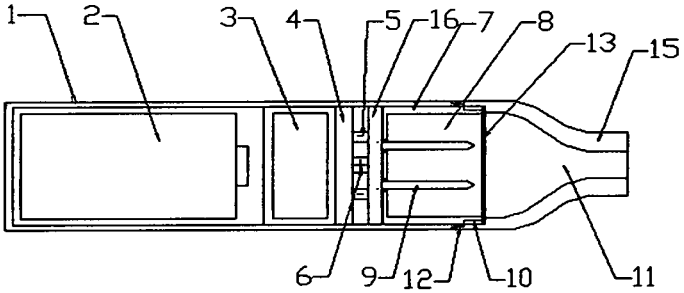
FIG. 5(*a*) is a sketch view of an electrically heated cigarette with needle-type heaters after assembling according to a fourth preferred embodiment of the present invention.
Figure 5B:
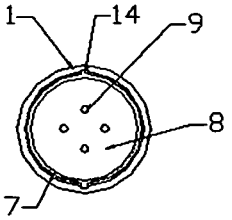

Referring to FIG. 5(*a*) and FIG. 5(*b*), according to the fourth preferred embodiment of the present invention, an electrically heated cigarette with needle-type heaters is provided, wherein the number of the needle-type heaters is four. In the fourth preferred embodiment, the four needle-type heaters are arranged in square, and other structures are basically same as that shown in FIG. 2(*a*) and FIG. 2(*b*).

According to the fourth preferred embodiment, the number of the needle-type heaters 9 is four. During a process of inserting the needle-type heaters into a tobacco product, a density of the tobacco product changes, so that a total weight of the prepared tobacco product is required to be kept at 400 mg-500 mg, which facilitates inserting of the tobacco product.

According to the fourth preferred embodiment, a preparation process of the tobacco product comprises steps of: drying tobacco leaves and crushing; sieving 1000 g tobacco powders smaller than 100 meshes; weighing 80 g carboxymethyl cellulose and 30 g agar, dissolving in 500 g water, stirring with the tobacco powders, and uniformly mixing; preparing into tobacco sheets and drying; after cutting the tobacco sheets into shreds, adding 150 g first atomizing agent which consists of glycerin and propylene glycol with a weight ratio of 3:1, baking for 30 minutes at 60° C., and keeping aside; meanwhile, weighing 1000 g tobacco shreds, spraying 150 g second atomizing agent which consists of glycerin and propylene glycol with a weight ratio of 2:1, baking for 30 minutes at 60° C., and keeping aside; uniformly mixing the prepared tobacco sheets and tobacco shreds with a weight ratio of 1:1; adding tobacco extract accounting for 4% of a total weight of the tobacco product and tobacco essence and flavor accounting for 1.5% of the total weight of the tobacco product, wherein a flavor precursor of vanillin glycoside, such as vanillin glucoside, is added into the tobacco essence and flavor according to the fourth preferred embodiment; after uniformly mixing, wrapping with flame retardant paper, and preparing into smoke bombs.

The prepared smoke bomb wrapped by the flame retardant paper is firstly placed into the heating cavity 8, and thereafter smoothly inserted to the heaters 9 with the cigarette holder. During heating, smoke rapidly generates; because of addition of the vanillin glucoside, the smoke bomb does not have an obvious milk flavor; when using, the milk flavor is obvious. The cigarette is able to reach a decomposition temperature of the vanillin glucoside, so as to increase a taste of the smoke.

Fifth Preferred Embodiment

Figure 6:
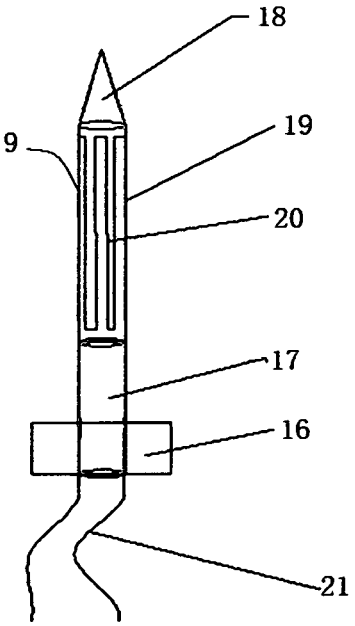
FIG. 6 is a structural sketch view of a needle-type heater according to a fifth preferred embodiment of the present invention.
Figure 7:
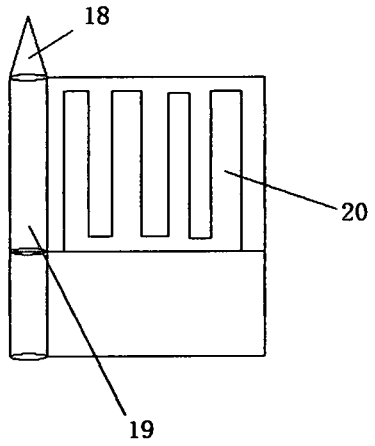
FIG. 7 is an expanded view of the needle-type heater according to the fifth preferred to embodiment of the present invention.

Referring to FIG. 6 and FIG. 7, according to the fifth preferred embodiment, a needle-type heater 9 is provided, comprising a needle-shaped heating body and a heating element 20, wherein the needle-shaped heating body comprises a tapered cap 18 and a heater substrate 19 connected with a bottom of the tapered cap 18; the tapered cap 18 is in a tapered structure of circular cone or triangular pyramid and connected with the heater substrate 19 to form a major structure of the needle-type heater; the tapered cap is welded or integrated with the heater substrate; the heater substrate 19 is in a columnar structure of circular cylinder or triangular prism, which corresponds to the shape of the tapered cap 18. The heating element 20 is attached to the heater substrate 19 in a way of coated printing. The heater substrate 19 is fixed (for example, through inserting) on a heater supporting seat 17, and the heater supporting seat 17 is fixed on a heater base 16. In other embodiments, it is feasible to directly fix the heater substrate 19 on the heater base 16.

In order to be better inserted into a cigarette, the columnar structure generally has a diameter not more than 2.5 mm and a length controlled between 10 mm-25 mm. Electrodes are arranged at a tail end of the heater substrate 19 and connected to a battery and a control board through connecting wires 21.

Sixth Preferred Embodiment

Figure 8:
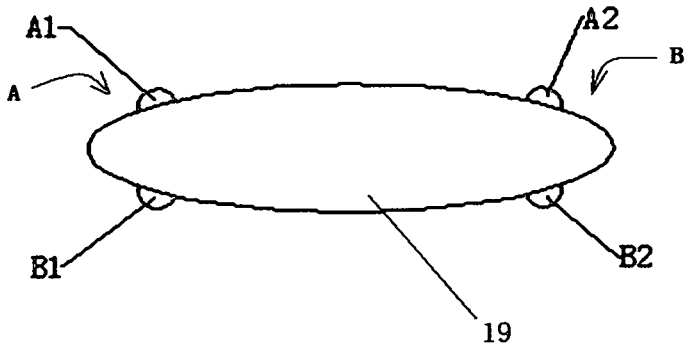
FIG. 8 is a layout sketch view of electrodes at a bottom of a heater substrate according to a sixth preferred embodiment of the present invention.

FIG. 8 shows a structural sketch view of a needle-type heater for an electrically heated cigarette, wherein: a heater substrate 19 has an elliptic cylinder structure; in order to be better inserted into the cigarette, the elliptic cylinder structure generally has a short diameter not more than 2.5 mm, a long diameter not more than 6.5 mm and a length controlled between 10 mm-25 mm, and an eccentricity of the ellipse is controlled between 0.05-0.9, which can be appropriately adjusted according to the heater; electrodes at a tail end of the heater substrate 19 are connected to a battery and a control board through connecting wires. In the sixth preferred embodiment, the electrodes of the heater substrate 19 comprise a first electrode A and a second electrode B, wherein: each electrode comprises two curved-surface resistance elements; that is to say, the first electrode A comprises a first curved-surface resistance element A1 and a second curved-surface resistance element A2, and the second electrode B comprises a first curved-surface resistance element B1 and a second curved-surface resistance element B2; A1 and B1 are connected to form one electrode, and A2 and B2 are connected to form the other electrode; after connecting the two curved-surface resistance elements in parallel, they are further connected to the battery and electrodes of a control circuit. In the above structure, resistance slurry is uniform at two surfaces, and the electrodes are arranged at two sides; the electrodes can be adopted as a support and connected to a circuit board, so that an invalid length of the heater is decreased and a thermal loss is reduced.

Seventh Preferred Embodiment

Figure 9:
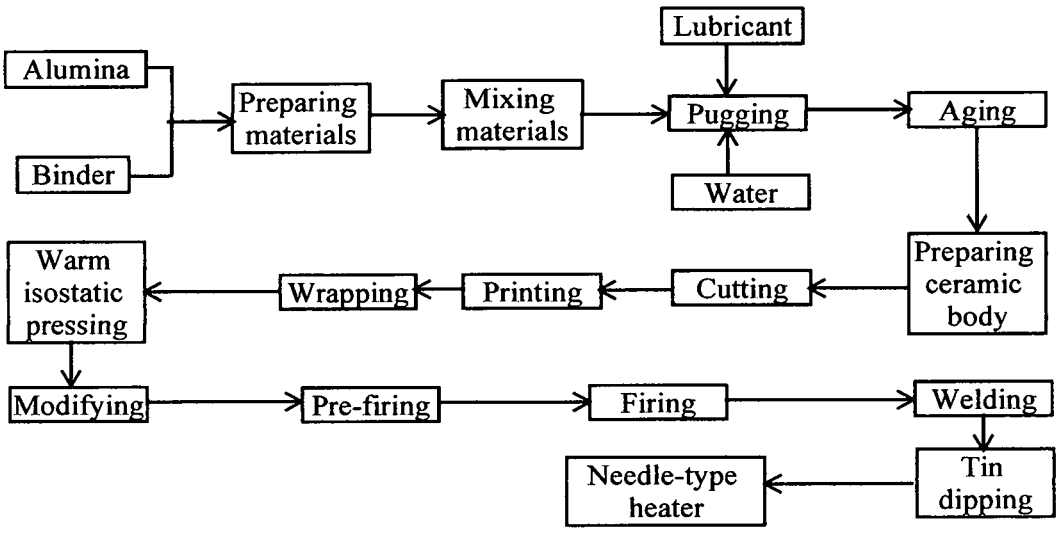
FIG. 9 is a preparation flow chart of a needle-type heater for an electrically heated cigarette according to a seventh preferred embodiment of the present invention.

Referring to FIG. 9, a preparation method of a needle-type heater for an electrically heated cigarette comprises steps of:

(1), preparing and mixing materials: weighing high-purity alumina powders of D50<0.8 μm, and adding into a ball mill; then adding a certain amount of milling balls, wherein a weight ratio of the alumina powders to the milling balls is 1:2; then adding a binder into the ball mill, wherein the binder is carboxymethyl cellulose and accounts for 12% of a total weight of raw materials; and continuously milling until the alumina powders and the binder are uniformly mixed; wherein: the alumina powders can be prepared in following composition proportions:

| | Components (weight %) | | | | | | | |
|---|---|---|---|---|---|---|---|---|
| Formula | Alumina | Wollastonite | Quartz | Kaolin | Limestone | Calcium silicate | Mullite | Cordierite |
| 1 | 96 | 0 | 0 | 0 | 0 | 4 | 0 | 0 |
| 2 | 96 | 3 | 1 | 0 | 0 | 0 | 0 | 0 |
| 3 | 99 | 1 | 0 | 0 | 0 | 0 | 0 | 0 |
| 4 | 90 | 3 | 2 | 1 | 2 | 1 | 0 | 1 |
| 5 | 93 | 1 | 2 | 1 | 1 | 1 | 1 | 1 |
| 6 | 85 | 1 | 2 | 4 | 2 | 3 | 1 | 2 |

(2), pugging: taking out the mixed powders; adding a lubricant (consisting of 40% soybean oil and 60% tung oil) which accounts for 8% of the total weight of the raw materials; then adding water which accounts for 15% of the total weight of the raw materials; uniformly stirring until uniformly mixed; taking out stirred pug, and placing into a rough pug mill for rough pugging; and repeatedly pugging for at least three times;

(3), aging: wrapping the alumina pug by a plastic wrap; aging for at least 48 hours; and obtaining a 96% alumina flexible ceramic body; wherein: because the alumina powders are non-hydrophilic non-plastic poor materials, liquid composition such as moisture in the pug still cannot be uniformly distributed in the pug after repeated pugging, so that aging for a certain time is necessary;

(4), cutting the ceramic body: placing the 96% alumina flexible ceramic body with a thickness of 0.1 mm on a mechanical punch for size punching; and, after punching, obtaining a cuboid which has a length of 25 mm, a width of 7 mm and a height of 0.1 mm;

(5), printing: in a dust-free environment, printing resistance slurry (such as a resistance wire) on the flexible ceramic body after punching, so as to form a heating element thereon; and printing an electrode which is connected to the heating element;

(6), wrapping: wrapping the flexible ceramic body with the printed heating element and electrode on an alumina ceramic rod which has a diameter of 1.6 mm and a length of 25 mm;

(7), forming: after warm isostatic pressing by a warm isostatic pressing machine at a temperature near 95-100° C., forming into a needle-shaped ceramic body which has a diameter of 1.8 mm and a height of 25 mm;

(8), modifying: punching a heating-type ceramic sleeve preform body obtained after forming by the punch, and forming a tapered cap; checking and modifying sizes thereof;

(9), pre-firing: heating the modified ceramic sleeve preform body in a rubber removal furnace from a room temperature to 500° C. with a speed of <5° C./min, wherein: the temperature is kept at 100° C., 200° C., 300° C. and 400° C. respectively for 30 minutes and kept at a highest rubber removal temperature of 500° C. for 120 minutes, so as to completely remove organics;

(10), firing: in a reducing atmosphere filled with hydrogen, firing with a temperature increased to 500° C. with a speed of 10° C./min and then to 1650° C. with a speed of <5° C./min, wherein the temperature is kept at 700° C., 900° C., 1100° C. and 1300° C. respectively for 30 minutes and kept at a highest firing temperature of 1500° C. for 120 minutes; and glazing after finishing firing, so as to protect the heating element and increase a heating speed of the heater to tobacco;

(11), welding: welding a connecting wire at the electrode of the heating-type ceramic sleeve after firing; and (12), tin dipping: processing the heating-type ceramic sleeve after welding with tin dipping at a welding point for 2-3 seconds.

The above-described is only preferred embodiments of the present invention, and the protection scope of the present invention is not limited thereto. Modifications and replacements which can be easily obtained by one skilled in the art based on the disclosed technical solutions of the present invention are all encompassed within the protection scope of the present invention. Therefore, the protection scope of the present invention is subject to the protection scope of following claims.

What is claimed is:

1. A production method of a needle-type heater, comprising steps of:

(1), preparing and mixing materials: weighing alumina powders of D50<0.8 μm, and adding into a ball mill; then adding a certain amount of milling balls, wherein a weight ratio of the alumina powders to the milling balls is 1:2; then adding a binder into the ball mill, wherein the binder accounts for 3-15% of a total weight of raw materials; and continuously milling until the alumina powders and the binder are uniformly mixed;

(2), pugging: taking out the mixed powders; adding a lubricant which accounts for 3-10% of the total weight of the raw materials; then adding water which accounts for 15-20% of the total weight of the raw materials; uniformly stirring until uniformly mixed; taking out stirred pug, and placing into a rough pug mill for rough pugging; repeatedly pugging for at least three times, and obtaining alumina pug;

(3), aging: wrapping the alumina pug by a plastic wrap; aging for at least 48 hours; and obtaining a 96% alumina flexible ceramic body;

(4), cutting the ceramic body: placing the 96% alumina flexible ceramic body on a mechanical punch for size punching; and, after punching, obtaining a required dimension of a heater substrate and a heater supporting seat;

(5), printing: in a dust-free environment, printing resistance slurry on the flexible ceramic body after punching, so as to form a heating element thereon; and printing an electrode which is connected to the heating element;

(6), wrapping: wrapping the flexible ceramic body with the printed heating element and electrode on an alumina ceramic rod;

(7), forming: after warm isostatic pressing by a warm isostatic pressing machine at a temperature near 95-100° C., forming into a needle-shaped ceramic body;

(8), modifying: punching a heating-type ceramic sleeve preform body obtained after forming by the punch, and forming a tapered cap; checking and modifying sizes thereof;

(9), pre-firing: heating the modified ceramic sleeve preform body in a rubber removal furnace from a room temperature to 500° C. with a speed of <5° C./min, wherein: the temperature is kept at 100° C., 200° C., 300° C. and 400° C. respectively for 30 minutes and kept at a highest rubber removal temperature of 500° C. for 120 minutes, so as to completely remove organics;

(10), firing: in a reducing atmosphere filled with hydrogen, firing with a temperature increased to 500° C. with a speed of 10° C./min and then to 1650° C. with a speed of <5° C./min, and forming a heating-type ceramic sleeve; wherein the temperature is kept at 700° C., 900° C., 1100° C. and 1300° C. respectively for 30 minutes and kept at a highest firing temperature of 1500° C. for 120 minutes;

(11), welding: welding a connecting wire at the electrode of the heating-type ceramic sleeve after firing; and (12), tin dipping: processing the heating-type ceramic sleeve after welding with tin dipping at a welding point for 2-3 seconds.

2. The production method of the needle-type heater, as recited in claim 1, wherein: the alumina powders are pure alumina powders or a combination of mixing the alumina powders with at least one member selected from a group consisting of aluminum nitride, vein quartz, sandstone, quartzite, quartz sand, flint, diatomaceous earth, mullite, cordierite, wollastonite, andalusite, limestone, quartz, kaolin, potassium oxide, sodium oxide, calcium oxide, magnesium oxide, ferric oxide and titanium oxide.

3. The production method of the needle-type heater, as recited in claim 1, wherein: the lubricant consists of soybean oil and tung oil; the soybean oil accounts for 40% of a total weight of the lubricant and the tung oil accounts for 60% of the total weight.

* * * * *